United States Patent [19]

Sihota

[11] 4,163,421

[45] Aug. 7, 1979

[54] MARKER FOR ROUND OR FLAT OBJECTS

[76] Inventor: Charan J. S. Sihota, 822 Oregon St., Bakersfield, Calif. 93305

[21] Appl. No.: 832,801

[22] Filed: Sep. 12, 1977

[51] Int. Cl.[2] ..... B41F 17/00

[52] U.S. Cl. ..... 101/41; 101/407 R; 108/62

[58] Field of Search ..... 101/41, 4, 3, 407 R; 108/13, 62

[56] References Cited

U.S. PATENT DOCUMENTS

| | | | |
|---|---|---|---|
| 382,801 | 5/1888 | Durkin | 101/407 R X |
| 484,718 | 10/1892 | Isaacs | 108/62 X |
| 2,002,847 | 5/1935 | Atti | 101/4 X |
| 2,372,089 | 3/1945 | Keller et al. | 101/41 |
| 2,382,174 | 8/1945 | Rott | 101/41 |
| 2,725,817 | 12/1955 | Kingsley | 101/41 |

FOREIGN PATENT DOCUMENTS

| | | | |
|---|---|---|---|
| 1009613 | 3/1952 | France | 108/62 |

*Primary Examiner*—Clifford D. Crowder
*Attorney, Agent, or Firm*—Howard I. Podell

[57] ABSTRACT

A marking device for round objects such as tennis balls which has a vertical stand, an object holder slidably secured to the bottom of the stand and movable through 180° to present a flat or a curved surface to the object, an inverted "L" shaped bracket vertically and slidably mounted on the stand, a type holder resiliently carried on the bracket, character type pivotally and removably secured on the holder, and a handle means to move the type holder toward an object on the object holder.

2 Claims, 3 Drawing Figures

ATOHI2LVAK

MARKER FOR ROUND OR FLAT OBJECTS

FIELD OF THE INVENTION

This invention relates generally to a device for marking flat or rounded objects.

STATEMENT OF PRIOR ART

The prior art, as exemplified by U.S. Pat. Nos. 1,537,685; 2,994,266; 2,621,591 and 1,139,689 is generally illustrative of various devices of this type. While such devices are generally acceptable for their intended purpose they have not proven to be entirely satisfactory in that they are either complex and expensive to manufacture, or bulky and inconvenient to use, or require unusual skill and/or dexterity to operate. As a result of the shortcomings of the prior art, typified by the above, there has developed and continues to exist a substantial need for devices of the character described. Despite this need, and the efforts of many individuals and companies to develop such devices, a satisfactory device meeting this need has heretofore been unavailable.

The principal object of this invention is to provide a device or article of this character which combines simplicity, strength and durability in a high degree, together with inexpensiveness of construction.

Other objects of this invention will in part be obvious and in part hereinafter pointed out.

SUMMARY OF THE INVENTION

My invention is a marking device for round objects such as tennis balls which has a vertical stand, an object holder slidably secured to the bottom of the stand and movable through 180° to present a flat or a curved surface to the object, an inverted "L" shaped bracket vertically and slidably mounted on the stand, a type holder resilliently carried on the bracket, character type pivotally and removably secured on the holder, and a handle means to move the type holder toward an object on the object holder.

BRIEF DESCRIPTION OF THE DRAWING

In the accompanying drawing, in which is shown one of the various possible illustrative embodiments of this invention, wherein like reference character identify the same or like parts.

DESCRIPTION OF THE PREFERRED EMBODIMENT

Figures 1, 2, 3, 4:
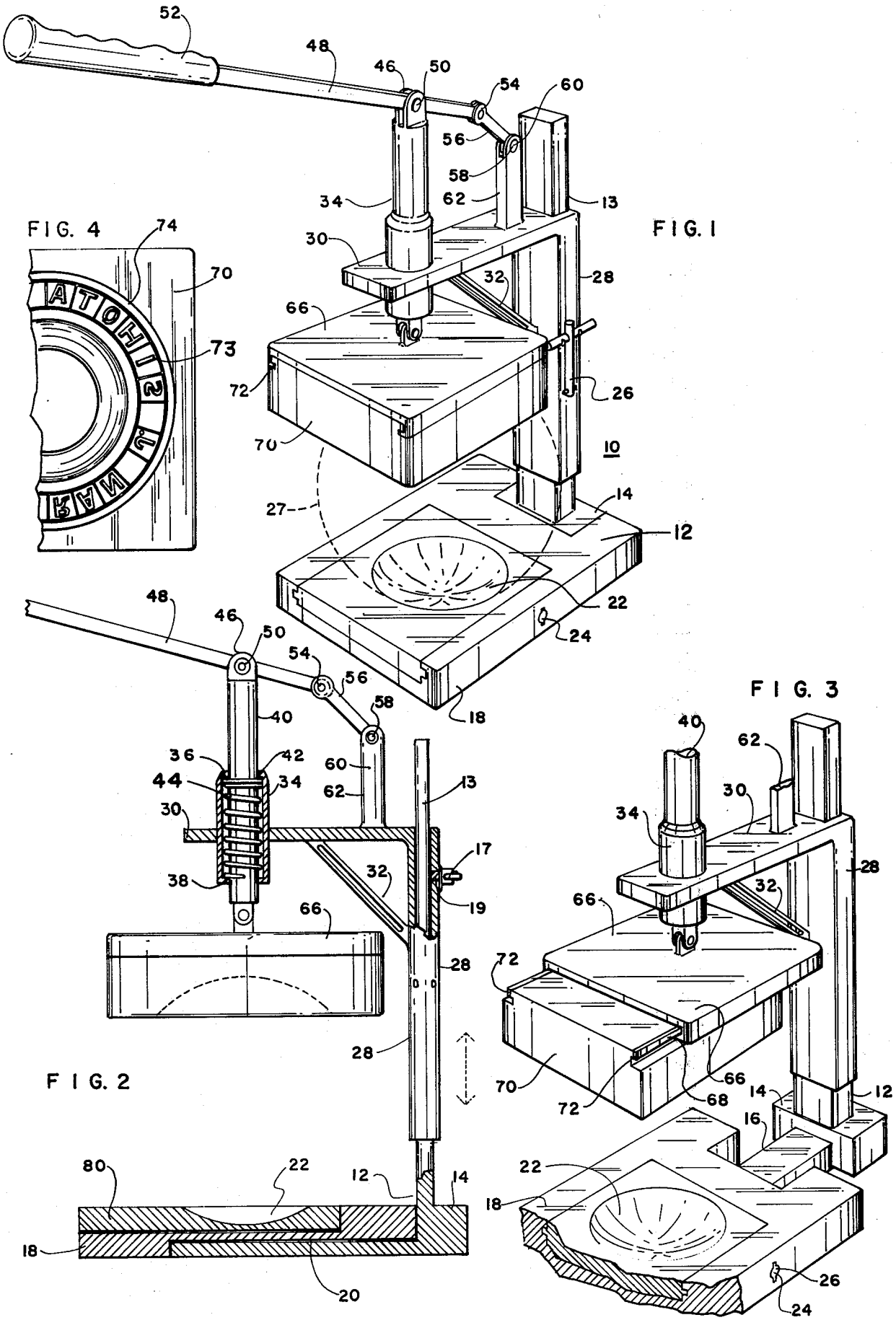
FIG. 1 is a view in perspective of the marker of the invention.
FIG. 2 is a side elevation partly in section of the device.
FIG. 3 is a perspective partial view showing the device partly disassembled.
FIG. 4 is a partial bottom view of the character type holder.

Referring in detail to FIG. 1, the device 10 includes a metal or plastic stand 12 which has an "L" shape vertical leg 13 and an inverted "T" shaped base or lower part 14. A horizontal rod 16 is integrally secured to base 14. Slidably mounted on rod 16 is an object holder 18 in which a flat plate 80 is slidably mounted in a tongue groove joint. Plate 80 has a flat face 20 and an opposite cupped face 22. A threaded bore 24 is provided in one side of holder 18 to screw in lock pin 26 whose end frictionally engages rod 16 at any desired point thereon. The tongue and groove joint allows reversing plate 80 to present either face to object 27 shown in phantom line on FIG. 1. Slidably mounted on leg 13 of stand 12 is an inverted "L" shaped bracket which has a sleeved vertical leg 28 mounted on leg 13 and a horizontal arm 30 extending outwardly therefrom. A diagonal support arm 32 extends between leg 28 and arm 30.

A set screw 17 in threaded opening 19 in leg 28 adjusts the height of leg 28 on element 13. A sleeve 34 is rigidly fixed in an opening in arm 30 and has a tapered upper end 36 (FIG. 2) and, at its lower end, an inner rim 36. A rod 40 is movable in sleeve 34 and has a keeper ring 42 in sleeve 34 bearing against expansion spring 44 whose lower end engages rim 36.

The upper end of rod 40 has a bifurcation 46 in which is pivoted lever arm 48 and pivot pin 50. A handle 52 is mounted on the outer end of lever 48 while its other end is pivoted by pin 54 to one end of link 56. The other end of link 56 is pivoted by pin 58 to the bifurcation 60 atop vertical bracket 62. The lower end of rod 40 is bifurcated and has pivoted thereto the vertically extending handle 64 of type holder 66. Holder 66 has its sides formed as slides 68 in which are slidably received the flanged sides of character holder 70. To ensure a tight fit, a rubber strip 73 is adhered to the sides of character holder 70.

The indicia 73 on the rubberized 74 bottom of holder 70 preferably are of the adhesive type to facilitate application and removal from the holder, as needed to use, the indicia is contacted with an inking pad or marking fluid, the object to be marked is placed on base 18 and handle is pushed down bringing the indicia down against object 27. Because of the resillient arrangement of the stamp holding the indicia there will be some "give" as contact is made with the object so that its original form will not be changed by the applied pressure.

As is well known, on many articles, such as golf balls, it is quite desirable that a name or other identification mark be place thereon so that ownership of any particular ball can be determined and established when some of the balls become mixed. Hand stamps have been used for such purposes but they can reach not more than half way around on a ball at most and, usually do not afford sufficient space to mark a full name. With a hand stamp, the marking is usually very poor since the balls are not smooth on the outside and there is no way to hold the ball so that a heavy pressure could be brought upon it with the hand stamp and, usually, there is no means of exerting enough pressure on the hand stamp to overcome the uneven surface of the ball, and the original form of the ball will be changed when a heavy pressure is brought onto the same with a hand stamp.

My invention provides a device which can be kept in a club house or other convenient place, which has sufficient leverage to create a mark on or in the surface of an article which can be used by any one and in any selective combination of characters, in which the markings can be created on the surface of the ball as desired, and in which the ball is held so that any pressure brought thereon during the marking operation does not change the original form of the ball.

It will thus be seen that there is provided a device in which the several objects of this invention are achieved, and which is well adapted to meet the conditions of practical use.

As various possible embodiments might be made of the above invention, and as various changes might be made in the embodiment above set forth, it is to be understood that all matter herein set forth or shown in the accompanying drawing is to be interpreted as illustrative and not in a limiting sense.

Having thus described my invention I claim as new and desire to secure by Letters Patent:

1. A marker for round and flat surfaced objects comprising a support including an object holder slidably and reversibly mounted thereon; said holder having a flat object-receiving surface on one side thereof and a cup-shaped receiving surface on the other; a type holder with character printing indicia mounted thereon and handle means resiliently connected to said type holder to move same vertically into contact with an object on said object holder to mark said object, wherein said support includes a vertical arm and a height adjustable sleeved bracket mounted thereon; said bracket having a horizontally extending arm, with lever means being pivoted on said arm and connected to said handle.

2. The invention as recited in claim 1, including a mounting sleeve on said arm, a rod resiliently mounted in said sleeve, said lever means being pivoted to the upper part of said rod and said type holder being pivoted to the lower part of said rod.

* * * * *